US006105411A

United States Patent [19]

Moriya

[11] Patent Number: 6,105,411

[45] Date of Patent: Aug. 22, 2000

[54] SURFACE SMOOTHING SYSTEM

[75] Inventor: Koji Moriya, Gifu-ken, Japan

[73] Assignee: Moriya Iron Works, Co., Ltd., Ibi-gun, Japan

[21] Appl. No.: 08/878,961

[22] Filed: Jun. 19, 1997

[30] Foreign Application Priority Data

Jun. 25, 1996 [JP] Japan ..... 8-185434

[51] Int. Cl.[7] ..... B21B 27/06

[52] U.S. Cl. ..... 72/75; 29/90.01; 29/90.5

[58] Field of Search ..... 72/75, 335, 199, 72/126; 29/90.01, 90.5

[56] References Cited

U.S. PATENT DOCUMENTS

| | | | |
|---|---|---|---|
| 2,861,483 | 11/1958 | Dosen | 72/75 |
| 3,820,210 | 6/1974 | Kalen | 29/90.01 |
| 3,845,533 | 11/1974 | Tinfow et al. | 29/90.01 |
| 3,934,443 | 1/1976 | Keen | 72/75 |
| 5,655,396 | 8/1997 | Siler | 72/75 |

FOREIGN PATENT DOCUMENTS

| | | | |
|---|---|---|---|
| 4113165 | 10/1991 | Germany | 72/362 |
| 4-9222 | 1/1992 | Japan | 72/75 |
| 1521569 | 11/1989 | U.S.S.R. | 72/75 |

*Primary Examiner*—Ed Tolan
*Attorney, Agent, or Firm*—Oblon, Spivak, McClelland, Maier & Neustadt, P.C.

[57] ABSTRACT

A surface smoothing system for smoothing a burr formed on a surface of a workpiece without dispersing waste dust includes a holder provided with a plurality of curved parts each projecting therefrom in a rocking manner and a rotation drive unit for rotating an end face from where the curved part held by the holder partially projects so that the curved parts contact the workpiece and smooth out the burr.

5 Claims, 6 Drawing Sheets

(a)

(b)

(c)

SURFACE SMOOTHING SYSTEM

BACKGROUND OF THE INVENTION

1. Field of the Invention

The present invention relates to a surface smoothing system for smoothing a protrusion such as a burr, flash or a fin formed on a front surface or a back surface of a workpiece without dispersing the protrusion nor scratching the workpiece surface.

2. Description of the Related Arts

Referring to FIG. 6, a workpiece 80 formed of, for example, a metal, resin, ceramics and the like, having holes 82 pierced through shearing work such as by a press or machining such as by a drill is likely to have a tiny protrusion 81 such as a burr formed on its surface.

The above sheared or machined section of the workpiece 80 having the protrusion 81 has been conventionally smoothed by cutting such protrusion 81 with a file or a grind stone.

Removing the protrusion 81 through the aforementioned conventional grinding technique may generate waste powder which scatters on a table or a floor or floats in the air as dust. Moreover, the grinding tends to cause a scratch on the workpiece surface that is required to be finished using a smooth-cut file.

SUMMARY OF THE INVENTION

An objective of the present invention is to provide a surface smoothing system for smoothing a protrusion such as a burr formed on a workpiece surface without dispersing the protrusion or scratching the workpiece surface.

The objective of the present invention is realized by a surface smoothing system for smoothing a protrusion such as a burr, flash or fin formed on a front surface or a back surface of a workpiece. The system comprises a holder having a plurality of curved parts each projecting therefrom in a (rocking manner) and a rotation drive unit for rotating an end face from where the curved part held by the holder projects so that the curved part contacts the workpiece.

This and other objects, features and advantages of the present invention will become more apparent upon a reading of the following detailed description in view of the drawings.

DETAILED DESCRIPTION OF THE INVENTION

Figure 1:
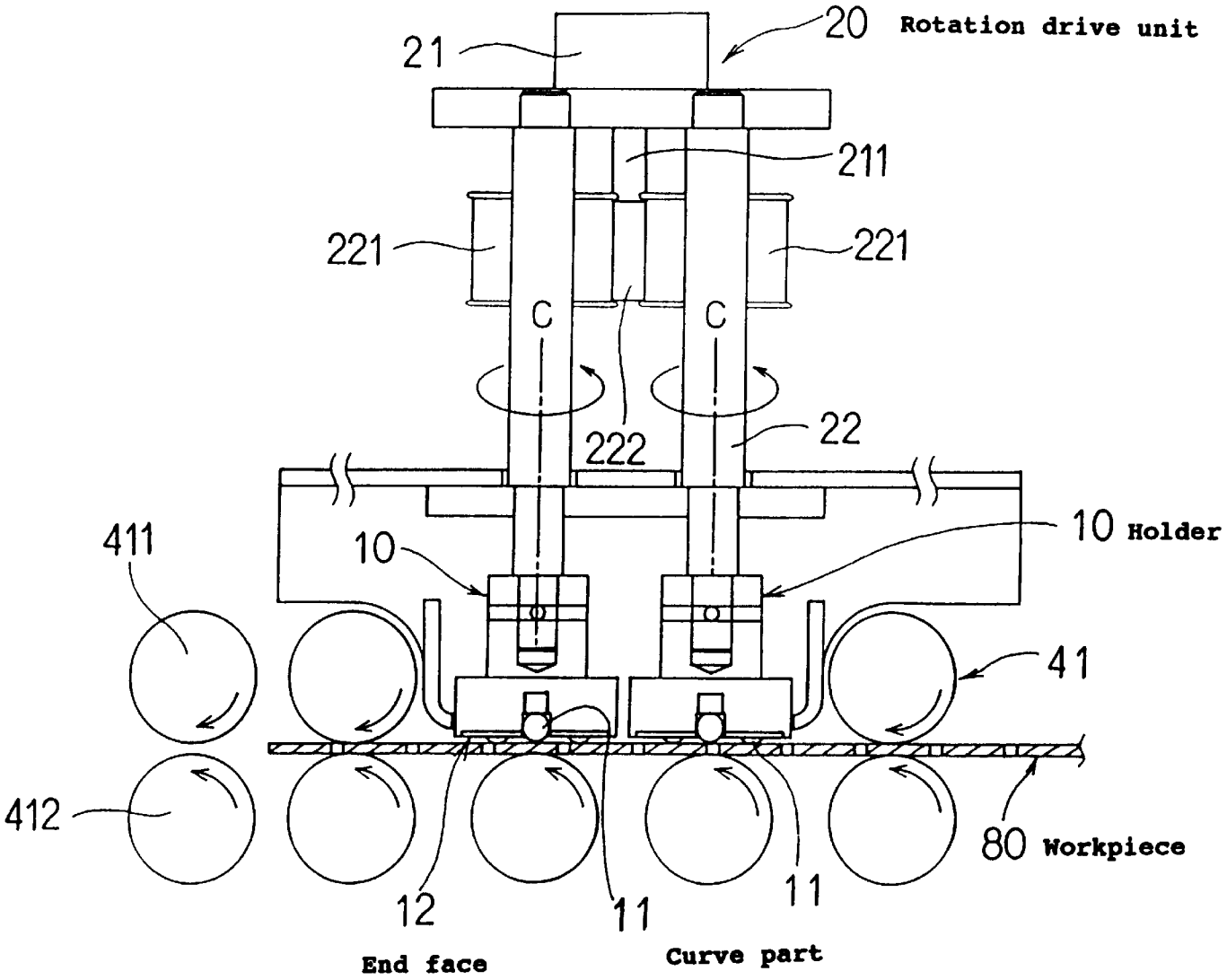
FIG. 1 is a front view of a surface smoothing system of an Embodiment 1.

The surface smoothing system of the present invention is characterized in FIG. 1 by a holder 10 having a plurality of curved parts 11 projected therefrom. An end face 12 from where each curved part 11 projects is rotated for contacting the curved part 11 and a workpiece 80.

Being contacted by the curved part 11, a protrusion such as a burr formed on the workpiece 80 is pressed under the curved part 11 into a shape parallel to the workpiece 80 or elongated. The burr may be pressed into a recess section.

As the workpiece 80 is contacted with the curved part 11 having no edge and allowing for a rocking motion, the burr can be smoothed without scratching the workpiece 80 or cutting the burr thereon.

The end face 12 from where the curved part 11 projects is a flat surface perpendicular to a rotation center axis C.

Figure 8:
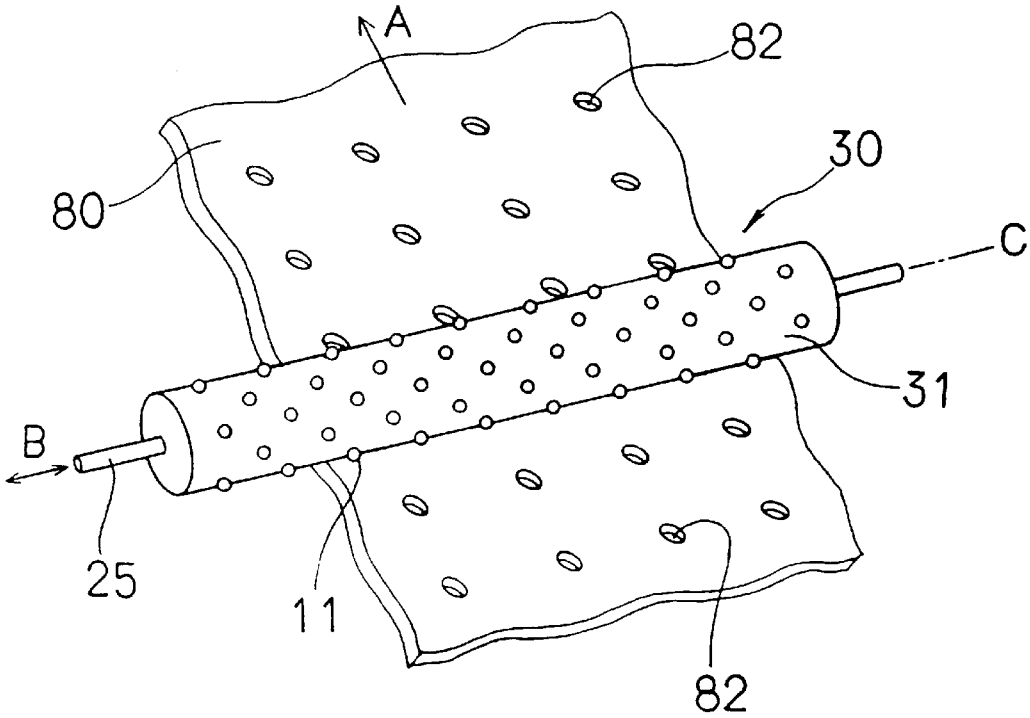
FIG. 8 is a perspective view of a holder of a surface smoothing system of an Embodiment 2.

In FIG. 8, an end face may be formed into a cylindrical surface 31 of a holder 30 to become approximately parallel to the rotation center axis C.

Figure 2:
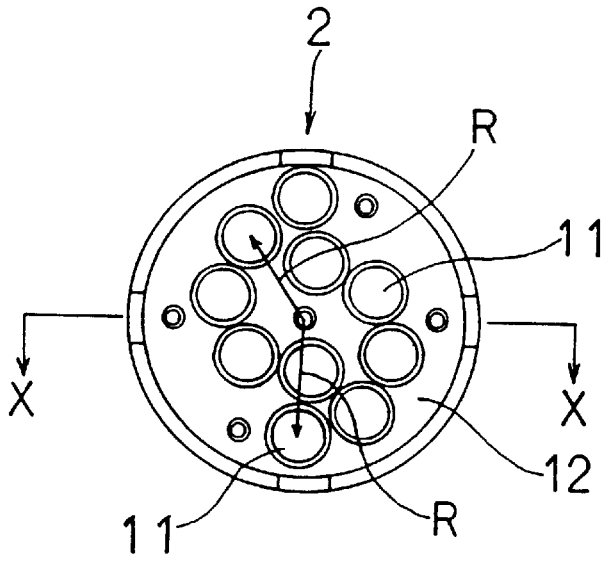
FIG. 2 is a bottom view of a holder of the surface smoothing system of the Embodiment 1.

Referring to FIG. 2, when the end face 12 is perpendicular to the rotation center axis, it is preferable to arrange the curved parts 11 so that values of a radius R of gyration of the respective curved parts 11 are uniformly distributed without causing bias. Referring to FIG. 8, when the end face is approximately parallel to the rotation center axis C, it is preferable to arrange the curved parts 11 so as to be distributed in the direction of the rotation center axis C.

Arranging the curved parts 11 as aforementioned may smooth the burr formed on the workpiece 80 uniformly.

Figure 3:
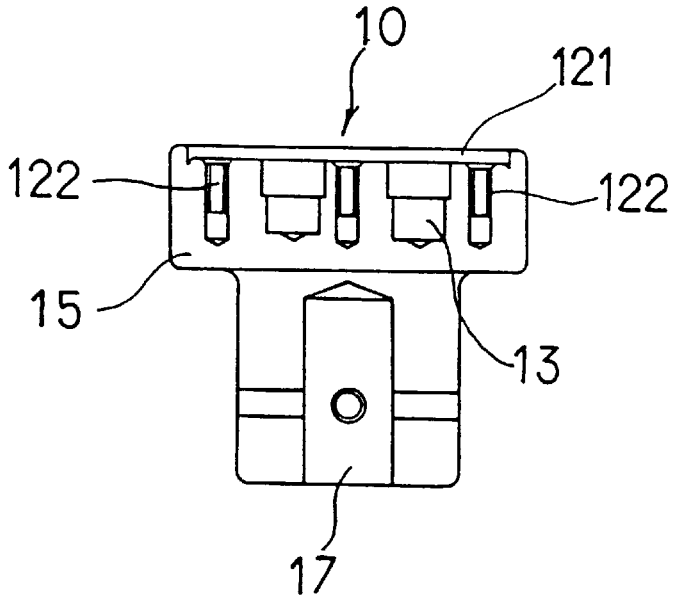
FIG. 3 is a sectional view along a line X—X of FIG. 2.

As seen in FIGS. 2 and 3, it is preferable to provide a mobile unit 2 with means for retaining the holder 10 so as to change the contact position between the curved part 11 and the workpiece. In addition to the rotation drive means, the mobile unit 2 may enable the curved part 11 to contact the workpiece uniformly. As a result, the burr formed on the workpiece surface can be evenly smoothed. The above arrangement allows the system to smooth the burr formed on the workpiece over a wider area by moving either the system or the workpiece.

Figure 4:
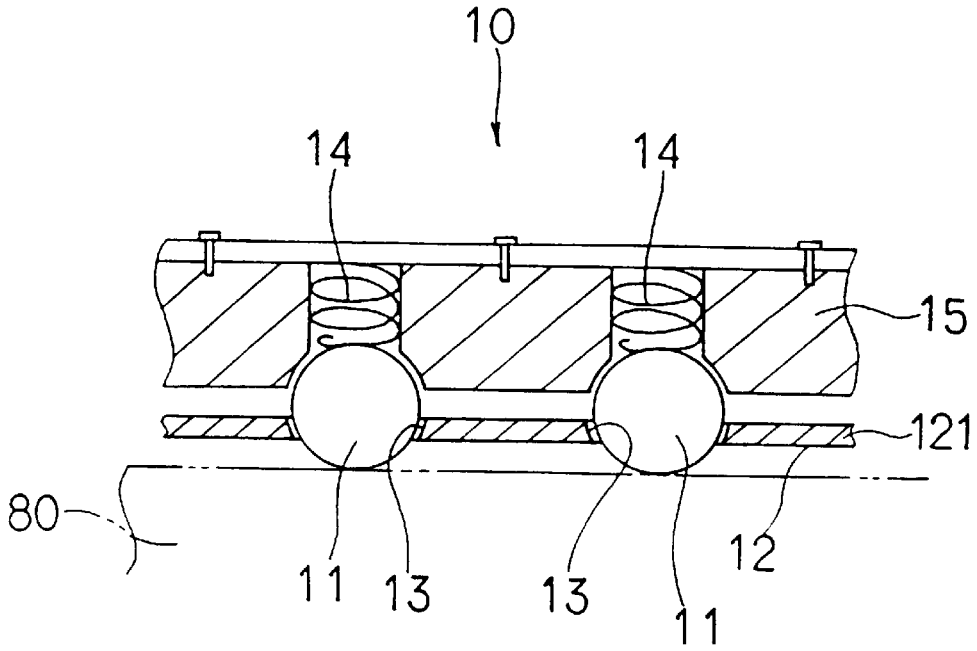
FIG. 4 is an enlarged front sectional view of the holder of the surface smoothing system of the Embodiment 1.

As seen in FIG. 4, it is most desirable for the holder 10 to have a secure hole 13 through which the curved part 11 partially projects from the end face 12 and to provide an elastic member such as a spring 14 elastically pressing the curved part 11 into the secure hole 13. Therefore, the curved part 11 is allowed to rock as well as suitably limiting its force toward the outside surface of the workpiece 80.

The curved part 11, thus, can be elastically contacted with the workpiece surface.

When the end face 12 is formed on a steel front plate 121, it is preferable to cure the periphery of the secure hole 13 to be harder than the other parts thereof through hardening treatment.

In order to prevent the secure hole 13 from being worn from frequent contact with the curved part 11, the end face 12 is formed of steel and the periphery of the secure hole 13 is further cured through the hardening treatment.

The curved part 11 may have a spherical body or a partially spherical body having a spherical surface by half (½) or a certain ratio (1/n).

The curved part 11 can be easily produced and hardly causes friction owing to its rolling characteristics. The amount of deformation of the burr can be controlled by selecting the suitable shape of the curved part 11.

The curved part 11 may be formed of steel, ceramics, hard resin and the like. The workpiece 80 may be formed of a metallic material such as steel, aluminum, ceramics and hard resin.

EMBODIMENT

Embodiment 1

FIG. 1 shows a surface smoothing system for smoothing the protrusion 81 (FIG. 6) such as a burr formed on either a front surface or a back surface of the workpiece 80.

The surface smoothing system is provided with a plurality of holders 10 each having a plurality of curved parts 11 projecting therefrom in a rocking manner and the rotation drive unit 20 for rotating the end face 12 from where the curved part 11 held by the holder 10 projects. The end face 12 is rotated so as to place the curved part 11 into contact with the workpiece 80.

Referring to FIG. 1, the end face 12 has a flat surface perpendicular to the rotation center axis C. Referring to FIG. 2, values of the radius R of gyration of the respective curved parts 11 to the rotation center axis C (not shown) are uniformly distributed without being biased to a certain value.

As FIG. 1 shows, the system is provided with a conveyor 41 for holding the workpiece 80 in order to change the contact position between the curved part 11 and the workpiece 80. A drive unit is also provided (not shown) to drive the surface smoothing system in a reciprocating manner at relatively slow speed.

Referring to FIG. 4, the secure hole 13 for holding the curved part 11 is formed through the end face 12 so that each curved part 11 partially projects therefrom. A spring 14 is further provided to elastically press the curved part 11 into the secure hole 13.

Figure 7:
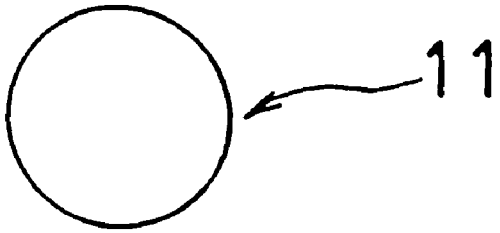
FIG. 7(*a*), (*b*) and (*c*) represent each shape of a curved part of the surface smoothing system of the Embodiment 1.
Figure 7:
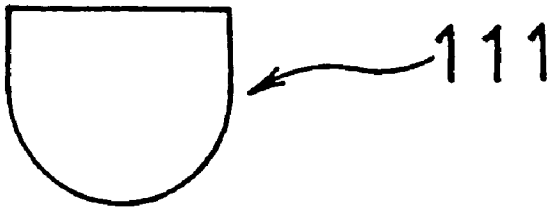
Figure 7:
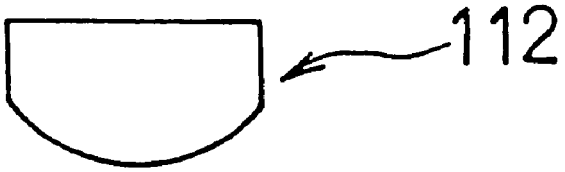

The curved part 11 is formed of a steel and has a spherical body as shown in FIG. 7(*a*).

Figure 5:
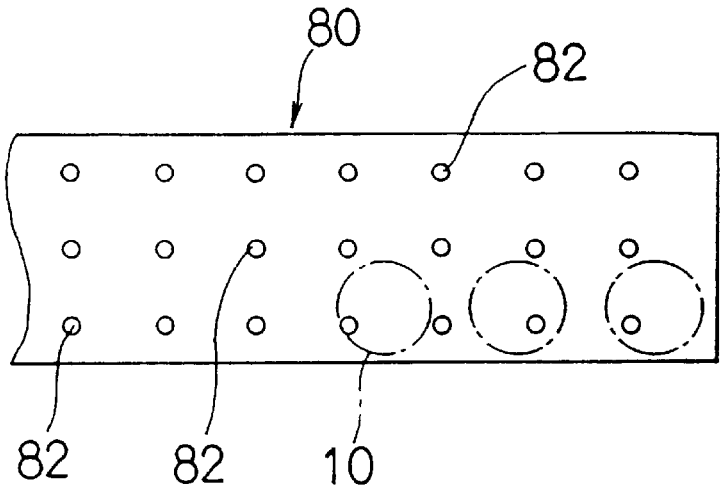
FIG. 5 is a plan view of a workpiece of the Embodiment 1.
Figure 6:
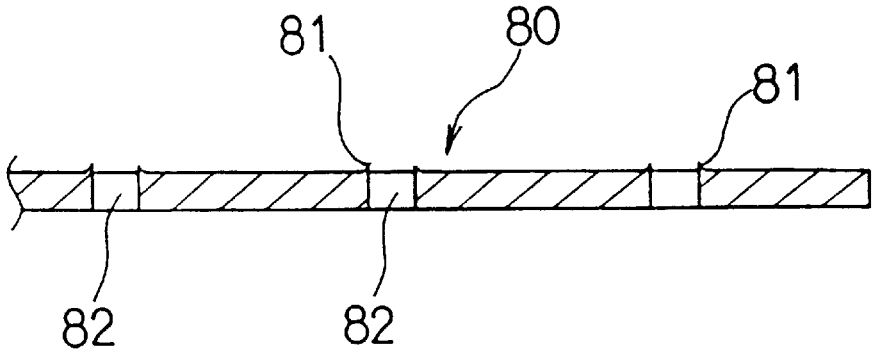
FIG. 6 is a sectional view of the workpiece of the Embodiment 1.

The workpiece 80 is a metallic plate with a large number of holes 82 pierced through by the shearing work such as by press punching as shown in FIGS. 5 and 6. The workpiece 80 has protrusions 81 formed on its surface.

The surface smoothing system is provided with twenty holders 10 arranged, for example, by 2 columns×10 rows. As shown in FIG. 1, the rotation drive unit 20 rotates the respective holders 10. Each holder 10 is provided with 10 curved parts 11 as shown in FIG. 2.

FIG. 3 is a cross sectional view of the holder 10 with the curved parts 11 removed. A plurality of screws 122 tighten the front plate 121 having the end face 12. Returning to FIG. 1, the rotation drive unit 20 is formed of a motor 21, a drive shaft 211, a drive axis 22 linked to the holder 10, a pulley 221 and a drive belt 222 transmitting power from the drive shaft 211 to the drive axis 22.

The conveyor 41 conveys the workpiece 80 interposed between pairs of rollers 411 and 412 each rotating in an opposite direction.

In FIG. 3, a central axis hole 17 is provided for embedding and fixing the drive axis 22 therein.

The holder 10 having a cylindrical shape is connected to the drive axis 22. The holder 10 is formed of the front plate 121 having the end face 12 and a plurality of the secure holes 13 pierced therethrough and a body section 15 having a plurality of the springs 14 embedded therein.

The holder 10 is driven by the rotation drive unit 20 for rotation at a high speed. As seen in FIG. 1, the end face 12 rotates parallel to the surface of the workpiece 80.

As shown in FIGS. 4 and 6, the protrusion 81 on the workpiece 80 in contact with the curved part 11 is pressed thereunder into a shape extended over a surface of the workpiece 80. The pressed protrusion 81 may be forced into the hole 82.

Accordingly the surface smoothing system of this Embodiment allows the protrusion 81 such as a burr on the surface of the workpiece 80 to be finished smoothly without dispersing the dust.

The curved part 11 is not limited to the one having the spherical shape. The curved part 11 may have a hemispherical contact section 111 as shown in FIG. 7(*b*) or a partially spherical contact section 112 as shown in FIG. 7(*c*).

Embodiment 2

Figure 9:
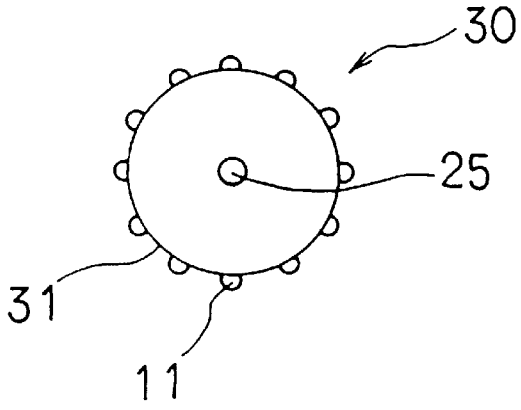
FIG. 9 is a side elevational view of the holder of the surface smoothing system of the Embodiment 2.

In this embodiment seen in FIGS. 8 and 9, an end face of the curved part 11 of a holder 30 has an outer cylindrical surface 31. The rotation center axis C serves as a center axis of the cylinder body. A pair of rotation drive axles 25 parallel to the surface of the workpiece 80 with holes 82 are provided to project from each end of the cylinder body.

The workpiece 80 moves in a direction A shown in FIG. 8 perpendicular to the rotation drive axle 25. The holder 30 rotatably moves in a reciprocative manner in a direction B (perpendicular to A).

Other features are the same as those of Embodiment 1.

The present invention provides a surface smoothing system for finishing the protrusion such as a burr on the workpiece surface without dispersing the dust resulting from cutting or scratching the surface of the workpiece.

While the invention has been described with reference to two embodiments, it is to be understood that modifications or variations may be made by a person of ordinary skill in the art without departing from the scope of the invention which is defined by the appended claims.

What is claimed is:

1. A surface smoothing system for smoothing a protrusion such as a burr, flash or fin formed on a surface of a workpiece, said system comprising:

a rotation drive unit formed of a motor, a drive shaft, a drive axis, a pulley and a drive belt transmitting power from the drive shaft to the drive axis;

a conveyor for moving the workpiece interposed between pairs of rollers, each rotating in an opposite direction; and a holder being linked to the drive axis and having a plurality of spring-loaded curved parts, each held in a secure hole in a front plate having an end face, for projecting therefrom so that the curved parts contact the surface of the workpiece and smooth the protrusion formed thereon while the workpiece is moved by the conveyor.

2. A surface smoothing system according to claim 1, wherein:

said end face of the front plate has a flat surface perpendicular to a rotation center axis of the holder and each value of a radius of gyration of each of the plurality of curved parts to the rotation center axis is uniformly distributed as a whole without being biased to a certain value.

3. A surface smoothing system according to claim 1, wherein:

said holder has a body section, a plurality of fasteners for tightening the front plate thereto, and a central axis hole for embedding and fixing the drive axis therein.

4. A surface smoothing system according to claim 1, wherein:

each of the plurality of curved parts has a hemispherical contact section.

5. A surface smoothing system according to claim 1, wherein:

said holder is a rotating cylinder body with an outer cylindrical surface, with a rotation center axis therethrough, and with a pair of rotation drive axles provided to project from each end of the cylinder body, said holder rotatably moving in a reciprocative manner in a direction perpendicular to a direction of movement for the workpiece through the conveyor.

* * * * *